United States Patent [19]

Fowles

[11] Patent Number: 4,889,256

[45] Date of Patent: Dec. 26, 1989

[54] PORT AND ELASTIC CLOSURE

[75] Inventor: Thomas A. Fowles, McHenry, Ill.

[73] Assignee: Baxter International Inc., Deerfield, Ill.

[21] Appl. No.: 837,664

[22] Filed: Mar. 4, 1986

Related U.S. Application Data

[63] Continuation of Ser. No. 670,852, Nov. 13, 1984, abandoned.

[51] Int. Cl.[4] ..... B65D 41/20

[52] U.S. Cl. ..... 220/306; 604/415

[58] Field of Search ..... 220/258, 306; 215/320; 604/408, 415

[56] References Cited

U.S. PATENT DOCUMENTS

| | | | |
|---|---|---|---|
| D. 185,724 | 7/1959 | Terwilliger | D58/10 |
| 2,669,369 | 2/1954 | Towns | 215/41 |
| 2,814,404 | 11/1957 | Towns | 215/41 |
| 2,907,489 | 10/1959 | Taylor, III | 220/258 |
| 3,073,472 | 1/1963 | Williams | 215/46 |
| 3,105,613 | 10/1963 | Barton et al. | 604/415 X |
| 3,223,269 | 12/1965 | Williams | 215/43 |
| 3,411,652 | 11/1968 | Shuffrey et al. | 215/41 |
| 3,994,412 | 11/1976 | Difiglio | 604/408 X |
| 4,008,820 | 2/1977 | Ruetz | 215/256 |
| 4,046,276 | 9/1977 | Winchell et al. | 215/320 X |
| 4,303,067 | 12/1981 | Connolly et al. | 604/408 |
| 4,482,070 | 11/1984 | Dubach | 215/253 |
| 4,484,916 | 11/1984 | McPhee | 604/415 X |

*Primary Examiner*—Steven M. Pollard

*Attorney, Agent, or Firm*—P. E. Schaafsma; R. Barrett; P. C. Flattery

[57] ABSTRACT

A port and closure assembly is provided. The closure includes a sleeve member and the port a rib member. The sleeve member having an inner circumference that is less than the outer circumference of the rib. The port and closure cooperating to produce an audible signal when the closure is removed from the port.

19 Claims, 1 Drawing Sheet

PORT AND ELASTIC CLOSURE

This application is a continuation of Ser. No. 6/670,852, filed 11/13/64, now abandoned.

BACKGROUND OF THE INVENTION

This invention relates to a port and closure assembly. In particular, the present invention relates to a port and elastic closure for a medical solution container.

Typically, elongated ports are utilized to access solutions contained in flexible containers. As used herein, the term ports includes, without limitation, fitments, valves, and other means for accessing a container. The ports function as injection sites or means for accessing the solution in the flexible container. To this end, the ports contain an open end that can receive a needle or other piercing means. In the medical field, these flexible containers may contain parenteral solutions, peritoneal solutions, and the like. An example of such a container is the VIAFLEX® collapsible plastic container for parenteral solutions sold by Travenol Laboratories, Inc. of Deerfield, Ill.

Fluids intended for intrabody administration must be sterile at the time of use to avoid the danger of introducing harmful agents into the body. Accordingly, the container must be able to house the solution so that the solution is maintained and extracted under sterile conditions. This requires not only that the container and its contents be in a sterile sealed condition at the time of receipt by the user, but also that no contamination of the contents occur when the container is opened by a physician, nurse, or medical technician prior to use. The problem of maintaining sterility is particularly acute at the port of the container where the fluid is accessed.

To guard against contamination a protective port closure is utilized with the port. One problem with the prior port closures is that they do not consistently provide an aseptic closure. Accordingly, user confidence with port and closure assemblies is not great.

Thus, there is a need for an improved closure that overcomes the problems of the prior art.

SUMMARY OF THE INVENTION

This invention provides a port and closure assembly for use on flexible containers designed to contain pharmaceutical and other medicinal solutions. The closure is designed to hermetically seal the port and cooperates with the port to produce an audible signal when the closure is removed from the port. To this end, the sleeve of the closure is designed to cooperate with a rib circumscribing the port to produce a snap when the closure is removed from the port. Accordingly, it is an advantage of the present invention to provide an elastic closure that produces an audible signal when it is removed from the tubular port and the partition wall of the tubular port is intact. Another advantage of the present invention is that it provides an elastic closure that aseptically seals the port. A further advantage of the present invention is that it provides an elastic closure that may be removed by the user with one hand. An additional object of the present invention is to provide an elastic closure that lends itself to mechanical assembly. A still further advantage of the present invention is that the closure includes ribs that aid in the molding process of the closure. Moreover, an object of the present invention is that it provides an outside wall structure of the port and a sleeve structure of the closure that cooperate to produce an audible signal when the closure is removed from the port. Additional features and advantages are described in, and will be apparent from, the Detailed Description of the Presently Preferred Embodiments and from the drawings.

DETAILED DESCRIPTION OF THE PRESENTLY PREFERRED EMBODIMENTS

Figure 1:
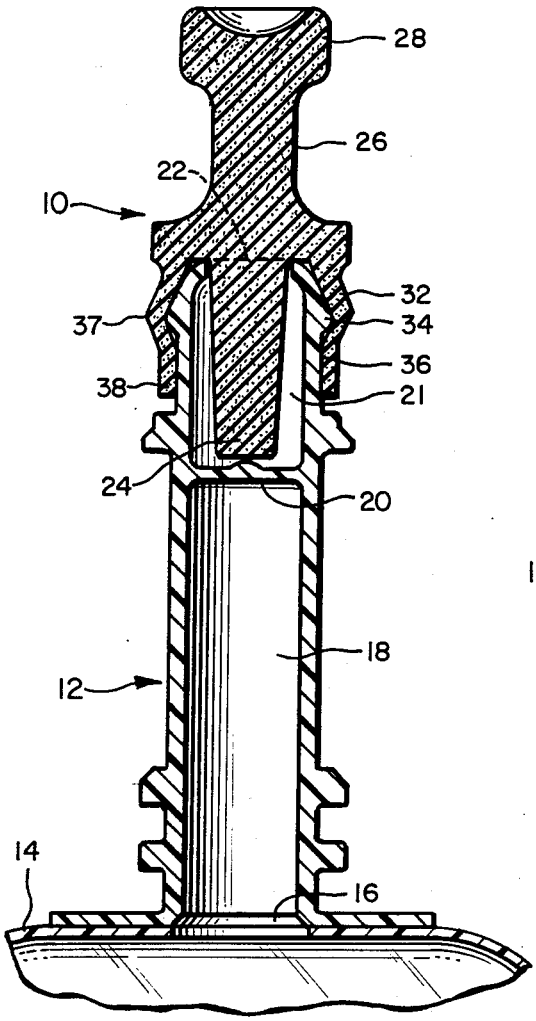
FIG. 1 illustrates a cross-sectional view of a preferred embodiment of the port and elastic closure of the present invention.

FIG. 1 illustrates the closure 10 and port 12 of the present invention. The port 12 extends from a solution container 14 and functions to provide a means of accessing the solution container. The solution container 14 includes an opening 16 which is in fluid communication with a lower tubular bore 18 in the port 12. The port 12 includes a partition wall 20 that divides the lower tubular bore 18 from an upper tubular bore 21. In order to access the container 14, and thereby the solution contained therein, the partition wall 20 must be broken or pierced. Typically, a needle or other sharp instrument is utilized to pierce the partition wall 20 and thereby access the fluid contained within the solution container 14.

The closure 10 functions to seal the opening 22 in the port 12. This is necessary to ensure than an aseptic environment is present within the upper tubular bore 21. If the upper tubular bore 21 is not maintained as an aseptic environment, when the partition wall 20 is pierced the fluid will be contaminated thereby introducing harmful agents into the patient's body.

The closure 10 includes a guide member 24 that is designed to be received within the upper tubular bore 21. The guide member 24 has an outer circumference that is less than the inner circumference of the upper tubular bore 21. Accordingly, when the guide member 24 is received within the upper tubular bore 21 a friction fit is not necessarily created.

The closure 10 includes a gripping member 26 that provides an area for the user to grip when it is desired to remove the closure 10 from the port 12. The gripping member 26 is an elongated member that may include a rib 28. Although one rib 28 is shown, a greater or lesser number of such ribs may be located on the gripping member 26. The ribs 28 also function to aid in the molding process.

Figure 2:
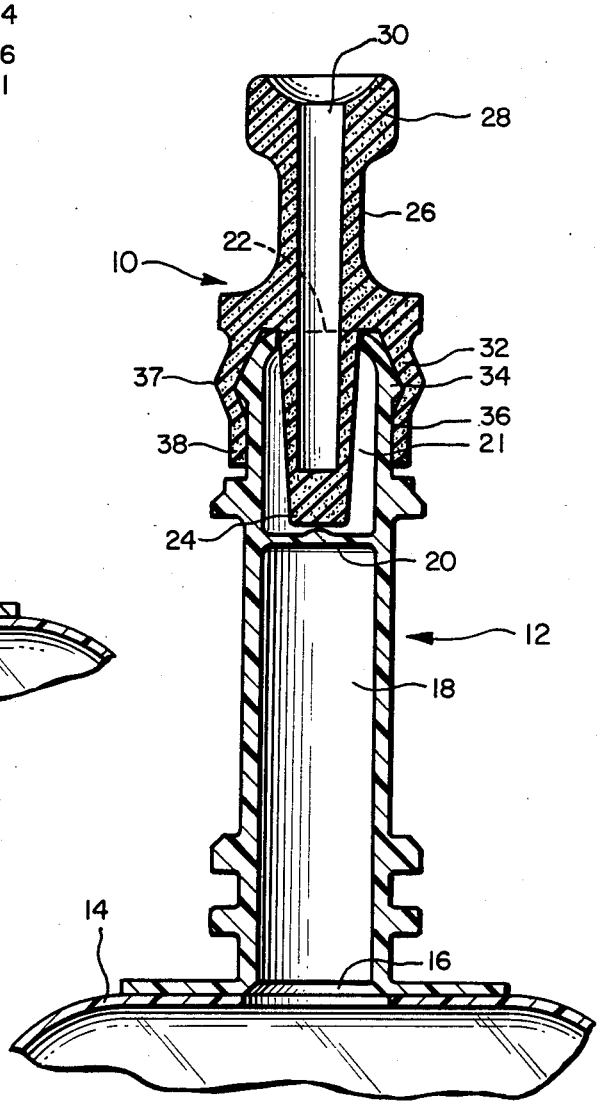
FIG. 2 illustrates a cross-sectional view of another preferred embodiment of the port and elastic closure of the present invention.

In the preferred embodiment illustrated in FIG. 2, the gripping member 26 includes a tubular bore 30. As illustrated, the tubular bore 30 may extend for substantially the entire length of the closure 10. The tubular bore 30 provides a closure 10 that is difficult to reinsert into the port 12 after it has been removed. Thus, a tamper evident closure 10 is provided. This provides a closure 10 that allows the user to be assured that the aseptic environment within the upper tubular bore 21 of the port 12 has not been violated.

The closure 10 includes a sleeve member 32. The sleeve member 32 is designed to cooperate with a rib member 34 located on the outer wall 36 of the tubular port 12. To this end, the sleeve member 32 has an inner circumference that is less than the outer circumference of the rib member 34. As illustrated in FIG. 1, when the closure 10 seals the port 12, the sleeve member 32 surrounds the rib member 34. Because of the circumferences of the sleeve member 32 and the rib member 34, a portion 37 of the sleeve member extends outwardly around the rib. When the sleeve 32 seals the port 12 the sleeve 32 further includes fingers 38 that extend downwardly from the rib 34.

The sleeve member 32 and rib member 34 cooperate to produce an audible signal when the closure 10 is removed from the fitment 12 and the partition wall 20 has not been broken or pierced. To this end, the outward portion 37 and fingers 38 cooperate with the rib member 34 to produce a "chinese fingers" effect producing an audible snap when the closure 10 is removed from the port 12 and the partition wall 20 has not been violated.

The audible signal provides not only an easy method of determining whether the partition wall 20 has been violated but also produces a positive psychological effect to the user and the patient. The audible signal indicates to the doctor or nurse utilizing the solution container 14, and the patient who is to receive the solution, that the hermetic seal between the closure 10 and the port 12 has just been broken.

Moreover, the sleeve member 32 and rib member 34 cooperate so that the closure 10 ma be removed from the port 12 through the use of only one hand. This provides a more readily usable closure 10 in that typically the nurse or doctor is only able to utilize one hand to remove the closure. The closure 10 is also user evident and does not require detail instructions.

The closure 10 is constructed from an ethylene propylene rubber. The ethylene propylene rubber provides a closure 10 that has properties similar to closures constructed from natural rubber. The preferred ethylene propylene rubber is EPDM. The closure 10 may be color coded. To expedite the identification of the solution contained in the solution container 14, the closure 10 may be colored red, green, blue or other color that identifies to the user the solution in the container.

Preferably, the closure 10 is compression molded, and the port 12 is injection molded. After the parts are molded, the closure 10 is fitted into the port 12. The closure 10 and port 12 assembly may then be steam sterilized. It is also possible to sterilize the closure 10 and the port 12 through bulk radiation sterilization and other methods known in the art.

The closure 10 provides a closure and port assembly that lends itself to mechanical assembly easily. To this end, the closure 10 provides a solid, nontacky surface that cooperates well with fitment attaching apparatus of packaging machines. An example of such an apparatus is the heat seal press head that utilizes a walking beam in a form, fill, 4nd seal packaging apparatus.

It should be understood that various changes and modifications to the preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

I claim:

1. A removable elastic closure for sealing the end of a tubular port comprising:

an elongated top member;

a guide member, the top member and guide member defining an inner bore;

a sleeve member surrounding the guide member having in an unstressed condition an inner circumference that is less than the outer circumference of a top portion of the tubular port;

the sleeve member and outer portion of the tubular port cooperating to produce an audible signal when the elastic closure is removed from the tubular port; and the guide member and inner bore cooperating to provide means for hampering the reinsertion of the elastic closure into the tubular port.

2. The elastic closure of claim 1 wherein the guide member has an outer circumference in an unstressed condition that is less than the inner circumference of the tubular port.

3. The elastic closure of claim 1 wherein the guide member has a greater length than the sleeve member.

4. The elastic closure of claim 1 wherein the elongate top member includes at least one rib.

5. The elastic closure of claim 1 wherein the elastic closure is constructed from an ethylene propylene rubber.

6. The elastic closure of claim 5 wherein the elastic closure is constructed from a EPDM rubber.

7. A port and closure assembly for a solution container comprising:

a tubular port for providing access to fluid with the solution container, the tubular port including an elongated bore, an outer wall defining the bore, a partition wall located in the bore, and a rib member circumscribing the outer wall;

an elastomeric closure for removably sealing the tubular port, including a guide member adapted to be received within the bore, and a sleeve for sealingly surrounding a portion of the outer wall of the tubular port; and the sleeve having an inner circumference in an unstressed state that is less than the outer circumference of the rib member, the sleeve having fingers that extend below the rib member when the closure seals the port, the fingers having an outer circumference that is smaller than the outer circumference of a portion of the sleeve that circumscribed the rib when the closure seals the port, the sleeve and tubular port cooperating to produce a Chinese finger effect and an audible signal when the closure is removed form the port if the partition wall is not pierced.

8. The port and closure assembly of claim 7 wherein the guide member has a greater length than the sleeve.

9. The port and closure assembly of claim 7 wherein the elastomeric closure includes a gripping member.

10. The port and closure assembly of claim 7 wherein the closure is constructed from an ethylene propylene rubber.

11. The port and closure assembly of claim 10 wherein the closure is constructed from a EPDM rubber.

12. The port and closure assembly of claim 7 wherein the inner circumference in unstressed condition of the sleeve is less than the outer circumference of the outer wall of the tubular port.

13. The port and closure assembly of claim 9 wherein the gripping member includes a tubular bore extending from an opening in a top of the gripping member substantially the entire length of the closure.

14. A port and closure assembly for a solution container comprising:

a tubular port for providing access to fluid within the solution container including, an elongated bore, an outer wall defining the bore, a rib circumscribing the outer wall, and a partition wall for dividing the elongated bore into an upper and lower bore;

an elastomeric closure for removably sealing the tubular port, including a guide member adapted to be received within the upper bore, gripping means for grasping the elastomeric closure, and a sleeve for sealingly surrounding a portion of the outer wall, the sleeve having in an unstressed condition an inner circumference that is less than the outer circumference of the rib circumscribing the outer wall of the tubular port; and the sleeve and rib cooperating to produce a Chinese finger effect and an audible signal when the closure is removed from the tubular port if the partition wall is intact.

15. The port and closure assembly of claim 14 wherein the gripping means includes a means for hampering the reinsertion of the port, the means including a tubular bore.

16. The port and closure assembly of claim 14 wherein the gripping means includes at least one rib member.

17. The port and closure assembly of claim 14 wherein the closure is constructed from an ethylene propylene rubber.

18. The port and closure assembly of claim 17 wherein the closure is constructed from a EPDM rubber.

19. The port and closure assembly of claim 14 wherein the closure is color coded.

* * * * *

UNITED STATES PATENT AND TRADEMARK OFFICE

CERTIFICATE OF CORRECTION

PATENT NO. : 4,889,256

DATED : December 26, 1989

INVENTOR(S) : Thomas A. Fowles

It is certified that error appears in the above-identified patent and that said Letters Patent is hereby corrected as shown below:

In column 4, at line 27, delete "with" and substitute --within-- therefor.

In column 4, at line 43, delete "circumscribed" and substitute --circumscribes-- therefor.

In column 4, at line 47, delete "form" and substitute --from-- therefor.

Signed and Sealed this

Sixteenth Day of October, 1990

*Attest:*

HARRY F. MANBECK, JR.

*Attesting Officer*

*Commissioner of Patents and Trademarks*